US006074271A

United States Patent [19]

Derrah

[11] Patent Number: 6,074,271

[45] Date of Patent: Jun. 13, 2000

[54] RADIO CONTROLLED SKATEBOARD WITH ROBOT

[76] Inventor: Steven Derrah, 726 Park Ave., Portsmouth, R.I. 02871

[21] Appl. No.: 09/191,026

[22] Filed: Nov. 12, 1998

Related U.S. Application Data

[63] Continuation-in-part of application No. 08/918,413, Aug. 26, 1997.

[51] Int. Cl.[7] ..... A63H 17/25; A63H 30/00

[52] U.S. Cl. ..... 446/457; 446/275; 446/288; 446/454; 446/460; 180/181; 280/87.042

[58] Field of Search ..... 446/273, 275, 446/276, 279, 288, 313, 431, 454, 456, 457, 460, 462; 180/180, 181; 280/87.042

[56] References Cited

U.S. PATENT DOCUMENTS

| | | | |
|---|---|---|---|
| 3,379,441 | 4/1968 | Feather et al. | 446/288 |
| 3,546,814 | 12/1970 | Melendez | 446/288 |
| 4,290,228 | 9/1981 | Goldfarb et al. . | |
| 4,836,819 | 6/1989 | Oishi et al. | 446/288 |
| 5,048,897 | 9/1991 | Yeh | 301/5.3 |
| 5,893,425 | 4/1999 | Finkle | 180/181 |

FOREIGN PATENT DOCUMENTS

| | | | |
|---|---|---|---|
| 2278064 | 11/1994 | United Kingdom | 446/456 |

*Primary Examiner*—Robert A. Hafer
*Assistant Examiner*—Laura Fossum
*Attorney, Agent, or Firm*—Cristina M Offenberg

[57] ABSTRACT

A radio controlled skateboarding toy is provided comprising a multi-jointed moveable figurine attached to a motorized skateboard for which steering is controlled through the pivotal movements of the figurine allowing for dramatic realism and high performance stunts. It also features moveable battery packs, changeable motor positions, and interchangeable wheel weights to provide different centers of balance necessary to perform a wide range of maneuvers.

17 Claims, 10 Drawing Sheets

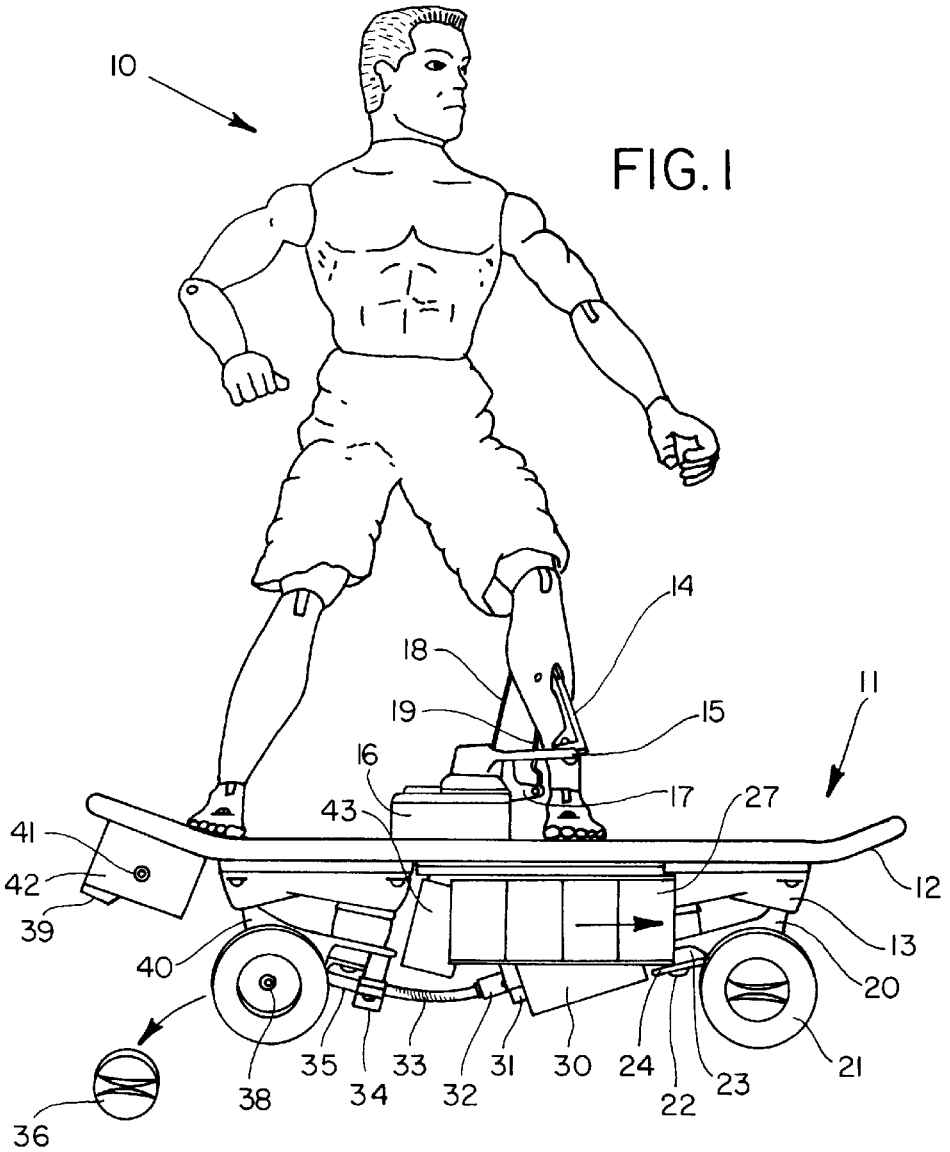
FIG. 1
FIG. 2
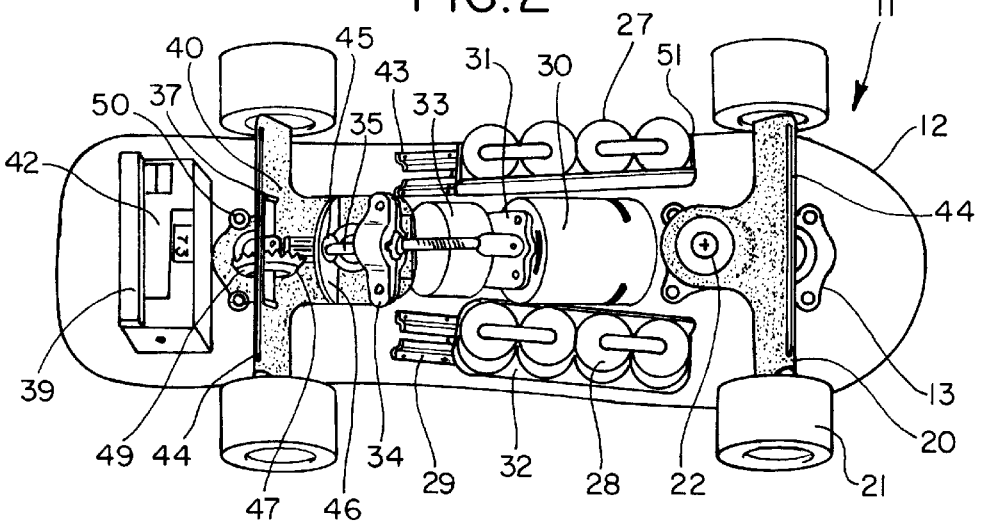

25
11
84
85
86
87

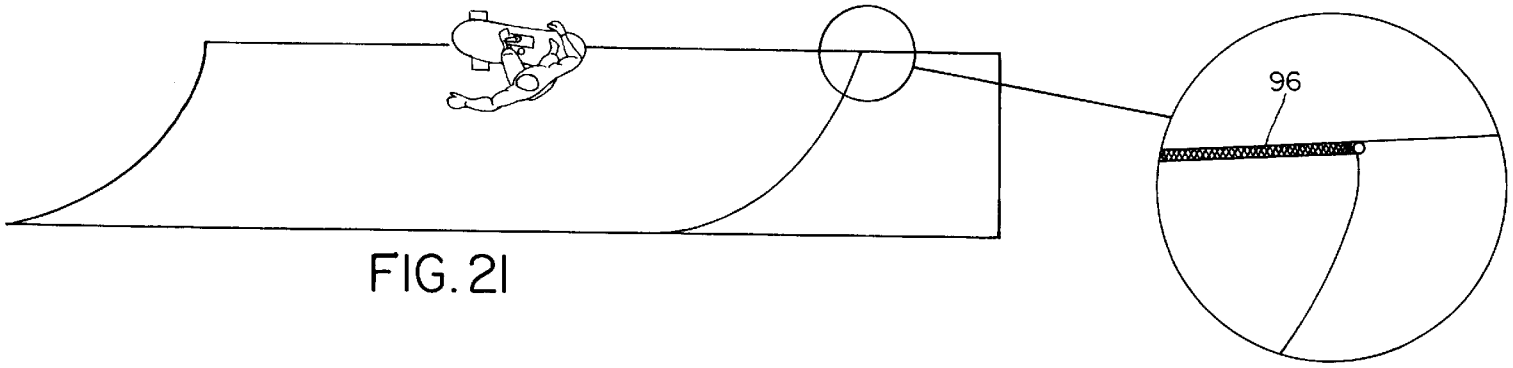
FIG. 21
FIG. 22
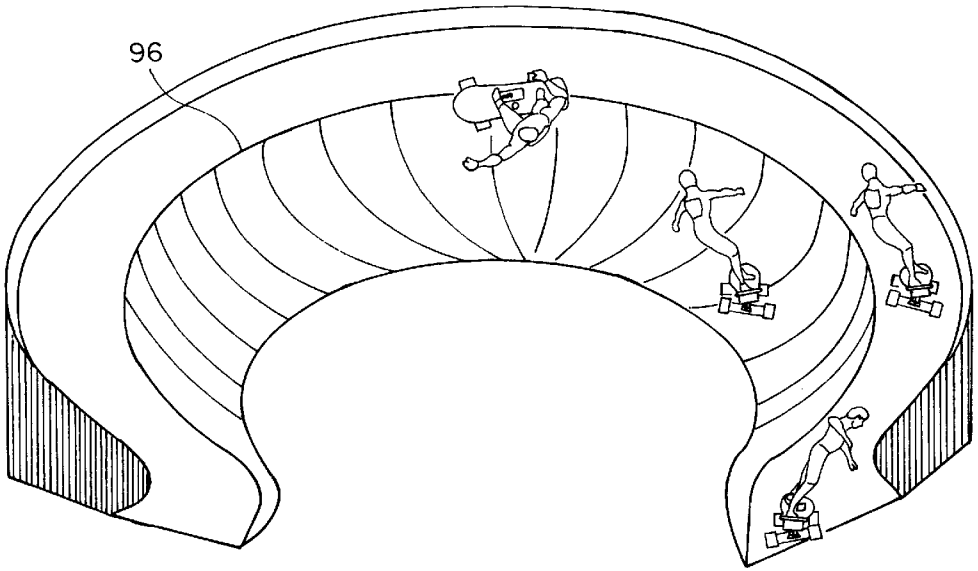
FIG. 23

RADIO CONTROLLED SKATEBOARD WITH ROBOT

This is a continuation in part of the Radio Controlled Surfboard with Robot—application Ser. No. 08/918,413 filed on Aug. 26, 1997.

FIELD OF INVENTION

The present invention relates to a radio controlled, motorized, skateboarding robot construction in the nature of a toy or amusement device.

BACKGROUND OF INVENTION—DESIGN THEORY

A skateboard is an unstable platform that a person stands on and rolls along on four wheels that are attached to two skateboard trucks and the trucks are secured to the underside of the skateboard.

The skateboard trucks allow a rider to steer the platform purely through weight transfers over to one side of the platform or the other. Both front and rear trucks are free-floating and both turn inward toward the center of the platform equally on the inside of any turn made and outward away from the center of the platform on the outside of any turn made. In other words all four wheels swivel in unison to track in different desired radii determined by the amount of weight applied to either side of the platform by the rider. This in turn tilts the platform inside rail down toward the running surface while the outside rail tilts away from the running surface. As the skateboard and trucks work together to track all four wheels through different radii left-hand and right-hand turns. No other four wheel vehicle steers in this manner; the steering is unique to the skateboard. Whether the skateboard is propelled downhill by inertia, centrifugal force, or by an electric-powered or gas-powered motor it is not a skateboard unless it can be steered by simple weight transfers applied to, and standing over, the upper surface of the platform's left or right flank.

The sport of skateboarding is unevenly split between free riding, street course, ramp, vertical, pool, downhill, slalom, dirt boarding, motor boarding, etc. all of these skateboarding categories were born out of the highly maneuverable nature and incredible tracking ability of skateboards. Also the skateboard can be made quite versatile when different truck widths, wheels, wheel bases and board shapes are applied to the three component vehicle.

The present invention was designed to imitate in a remote controlled toy the act of skateboarding as close as possible to real life skateboarding in an effort to generate the realism and excitement in order to be marketable to skateboarders and skateboard enthusiasts. The present invention "Robo Skater", is a toy skateboard with a robotic figurine, designed to perform almost every maneuver from all the different aspects of human skateboarding. The result is a highly maneuverable, directional toy that handles with enough precision to host a new competitive radio control sport as well as an enjoyable pastime.

BACKGROUND OF THE INVENTION—PRIOR ART

The following is a list of three close prior art patents:

U.S. Pat. No. 4,290,228, Goldfarb, et al.

U.K. Pat. No. GB 2,278,064 A, Kang Chong To

U.S. Pat. No. 4,799,915, Lehmann, et al.

These patents each disclose a vehicle with simulated-robotic operator which is designed to look as if the robot is operating or controlling the vehicle. Despite the similar appearances, the present invention is distinguishable from the above prior art in three ways:

First, even though these vehicles are visually operated by the arm and leg movements of an onboard robot, these movements only provide an effect of realism. The prior art vehicles could be steered without the robotic figurine. Like most battery powered radio controlled toys, the actual steering and operating is done by servos and speed controls inside the vehicle, hooked directly to the steering push rods and motor components. The toys of the prior art add a figurine for realistic effect only and it does not contribute to the movements of the toy.

In contrast to the prior art vehicles, the present invention's robotic figurine operates the toy skateboard. The vehicle uses authentic skateboard trucks and therefore could not possibly steer without a robotic figurine having substantial weight turning from side to side on the skateboard platform. The standing robotic figurine attaches to the motorized skateboard's deck and provides a mass of weight high above the skateboard platform which can be manipulated back and forth by a servo connected to the robotic figurine's lower leg. The servo allows the user of the skateboard toy to shift the robotic figurine's weight over either side of the platform to provide the inertia needed to steer the skateboard in that direction.

The second way the present invention is distinguishable from the prior art is that none of the above-mentioned prior art patents describe a skateboard or the operation thereof by means of a remote control. The present invention is the first invention of a toy skateboard that is controlled by a remote control unit.

Lastly, the present invention is absent of outwardly extending legs, auxiliary wheels or other assisting devices found on the prior art patents for stability. The stability of the present invention is contained in the design of the skateboard with a robotic figurine attached and does not need any outwardly extending legs or the like to keep it from tipping over.

The following is a list of three more close prior art patents:

U.S. Pat. No. 1,686,061, Allinger

U.K. Pat. No. GB 2,186,501A, Berenguer, Hermanos S. a.

U.S. Pat. No. 4,836,819 Oishi, et al

Although the above-referenced prior art patents all show figurines on top of a vehicle similar to a skateboard, they are not actually skateboards as are used by humans and furthermore are easily distinguishable from the present invention. Allinger (U.S. Pat. No. 1,686,061) is a square cart that is not powered and in which the wheels are not steerable. The figurine standing thereon bobs up and down for visual effect only and does not control the direction of the vehicle. Berenguer, Hermanos S. A. (U.S. Pat. No. 2,186,501) is a skateboard-like platform that allows different dolls to be attached however, they offer no robotic movements. It is radio controlled and battery powered but it departs from skateboard design due to the fixed rear wheels used to propel the vehicle. It also employs a movable front axle and wheel device that allows for steering. This mechanism has no resemblance to a skateboard truck. In other words, this toy steers like a radio controlled car, not a skateboard due to the missing basic components of a skateboard.

Oishi, et al (U.S. Pat. No. 4,836,819) shows a skateboard-like platform with an animal figurine on board which offers no functional robotic movements. It is a wind-up toy that has one rear drive wheel with two auxiliary wheels extending outward from the drive wheel. The moveable front axle and wheels steer the toy with the assistance of a push-rod extending out from the wind-up gear box at the midsection. Once the toy is wound up, it goes forward only in a limited snake-like pattern. This toy operates similar to a three-wheeled automobile with training wheels rather than like a skateboard. This toy is limited to doing one maneuver, as compared to the present inventions fifty-plus real-life skateboarding maneuvers.

None of the aforementioned prior art offer a standing robotic figurine imitating the true art form of the sport of skateboarding nor are they capable of performing any of the real-like skateboard moves as the present invention due to the fact that only the present invention skateboard toy can be steered by weight shifting of the robotic figurine. Additionally, it is evident by the differences in sales price that the prior art skateboards such as Oishi et al (U.S. Pat. No. 4,836,819) are not directly comparable to the present invention. They would sell for approximately five-dollars in comparison to the "Robo Skater" which should sell in the price range between $70.00 and $1,000.00 dollars, depending on the model.

Furthermore, the prior art skateboard, like toy Berenguer, Hormanos S A (U.K. Pat. No. 2,186,501), were designed to hold posing figurines and to transport them slowly and gently. They are unable to do any real skateboarding moves such as grinding street curbs or getting "big air" out of a vertical half-pipe, "landing it", or racing around a closed circuit course against other remote control toys. The difference in performance is evident in the maneuverability of the present invention.

It is noteworthy to mention that there is one toy that has a similar mode of steering to the present invention, Hoeting et al (U.S. Pat. No. 5,368,516). This art shows a battery powered radio controlled motorcycle with a simulated rider on board wherein a swing rod operated by a servo is connected to the rider which swings the rider's body from side to side to initiate turns. Motorcycles and skateboards both turn in much the same manner, by the rider leaning his body weight over to one side or the other. However, a motorcycle requires the additional task of steering the front wheel with the rider's arms and hands.

The major differences between Hoeting and the present invention is that the Hoeting patent is a two-wheeled motorcycle, not a four wheeled skateboard, and it uses only one sitting body movement that barely tips the cycle to one side; compared to the present invention's three synchronized standing body movements. This difference in body movements allows for the present invention to turn sharply and abruptly with precision, and without tipping over. Additionally the design of the two toys is completely different and therefore considerations for movement are different. The motorcycle's figurine is sitting down and therefore the center of gravity of the entire toy (vehicle and figurine) is dispersed differently than the skateboard toy in which the figurine is standing erect. The present invention's skateboard is comparably heavier than the robotic figurine which prevents the entire vehicle from tipping over. In designing present invention for its maneuverability, the center of gravity of the entire vehicle was taken into consideration. The robotic figurine stands erect in order to operate the direction of the skateboard by turning the body of the figurine from one side of the board to the other side.

The present invention can also turn in a three-foot circle without any wheel spin breaking traction which is a great difference compared to the motorcycle of Hoeting's patent that can only turn in a fifteen foot circle. If the present invention's rear wheel does break traction it can turn on its length. The turning radius is the reason why the remote control motorcycles are an outdoor use vehicle for the most part and allows for the remote control skateboard to be open to a be a larger market as it can be used indoors as well as outdoors. Lastly, the present invention has the ability of traveling both in a forward and reverse direction and the Hoeting motorcycle can only travel in a forward direction.

The "Robo Skater" is the result of the applicant's combination of his knowledge of skateboard design, mechanical design, action figure design and radio control mechanism with the addition of with newly invented designs to result in an unprecedented skateboarding device.

BRIEF DESCRIPTION OF DRAWINGS

FIG. 1 Is a right side view of the custom robot on a skateboard showing motor arrangement "A" and battery packs and wheel weights in the vertical riding position.

FIG. 2 Is a bottom view of the skateboard with motor arrangement "A".

FIG. 21 Is a front and side view of a typical quarter pipe with drop-in platform showing a robo skater grinding the coping.

FIG. 22 Is a close-up view of the serrated steel coping.

FIG. 23 Is an elevated front view of a skateboarding half-pool with a drop-in platform showing a robo skater entering at the floor.

DETAILED DESCRIPTION OF EMBODIMENTS

Six embodiments of the present invention are described. First is the custom design robot (10) which allows for more control and maneuverability. Second is the mass market design which can be made less expensive than the custom design, but has less maneuverability. The third through sixth designs are different motor and drive train arrangements which all work close enough to each other performance-wise and were outlined to preserve all avenues concerning drive trains pertinent to this design.

The electrical connections or wires are not shown in any drawings. It is assumed that all parts are connected to each other by the proper wiring and connections provided with each component. It would be too confusing to clearly see the many components in a drawing with wires running everywhere in between.

Figure 7:
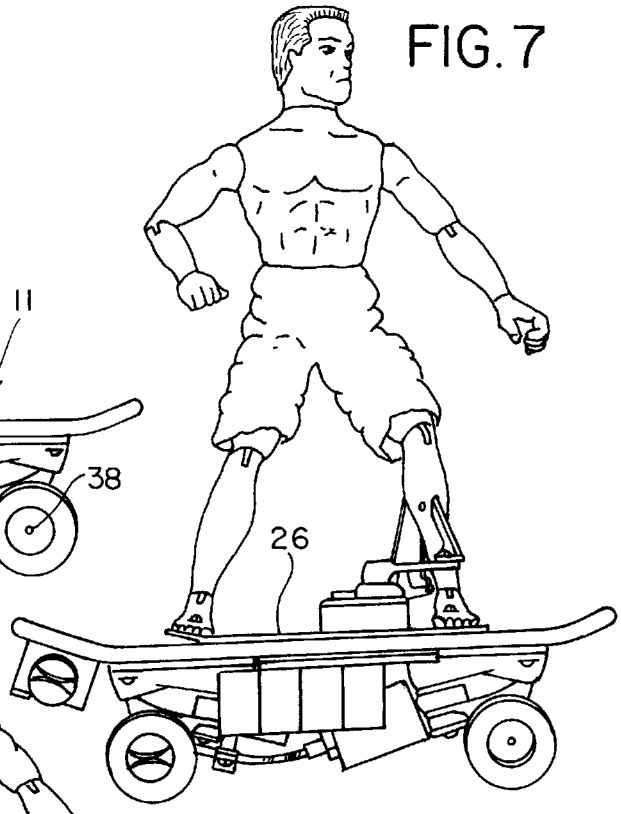
FIG. 7 Is a right side view of the robot on the skateboard showing motor arrangement "A" and the robot slide plate.

FIG. 1 shows the custom robot (10) which is fixed standing on the skateboard (11) equipped with motor arrangement "A". The robot (10) stands in a sideways surfer stance with the board's centerline traveling strait under the forward part of the robot's (10) ankles. The robot's (10) standing position is critical in relation to the wheel base of the front truck hanger (20) and truck base plate (13) placement, and weighted areas of the skateboard. The weighted areas being the 9.6 volt electric motor (30) the two moveable battery packs (shown in FIG. 2) and the four supplied snap-fit wheel weights (36). The custom robot's (10) wide stance has the rear foot pivotally fastened at the base of the tail kick of the skateboard deck (12) and the front foot just aft of the front truck hangar (20) and truck base plate (13) allowing for the robot (10) to be in the center balanced pivotal position to control the skateboard from nose to tail as well as rail to rail. The center of balance with the assistance of the moveable battery packs [FIG. 2—(27) (28)] can be changed and then locked in place to give the operator the control to participate in whichever facet of skateboarding he chooses. For instance, FIG. 1 shows the battery packs (27) (28) moved forward and the rear wheel weights (36) removed. This is the set up to ride vertical ramps and pools for aerial maneuvers. The emphasis on the weight forward helps the board (11) and robot (10) to maintain stable forward motion while in mid air and helps the skateboard (11) and robot (10) to nose dive back into the pipe with a front wheel landing. The other way to move weight fore and aft is shown in FIG. 7.

The skateboard deck (12) itself is preferably made from plywood but can be made out of plastic or some other pliable material. The front truck hangers (20) and flex driver hangar (40) and truck base plates (13) are preferably made out of heavy steel to increase the low center of gravity. If made out of aluminum or plastic, it is preferable to mold in lead weights or to attach weights to the front trucks hangars (20) flex-driver hangar (40). The wheel weights are preferably made out of lead with a plastic coating to prevent contamination or made of heavy steel. The upper truck rubbers (23) should be made out of a sponge rubber with excellent rebound characteristics, as well as, the correct durometer composition to carry the specific intended weight of the vehicle. The wheels (21) should preferably have metal hubs and heavy weight hard rubber or urethane tires. Regular skateboard wheels would work; but, not as good as the above-mentioned wheel arrangement.

FIG. 1 also shows the front truck base plate (13) connected to the front truck hangar (20) which is connected to the wheels (21) which have metal hubs that wheel weights (36) can be snap-fitted into by means of a special snap-fit axle end (38) with all four wheel weights (36) in place. The present invention has a low center of gravity.

The truck hangar (20) is able to rebound back to center between turns with the help of the rebound action of the rebound rubbers (23) which have donut holes in their middles through which the king pin (22) travels and is screwed into the truck base plate's (13) threaded hole. This assembly is fastened together with two cupped washers (24) on either end of the rebound rubbers (23). The rear truck shares the same truck base plate (13) rebound rubbers (23) king pin (22) and washers (24) as the front truck set up but has a flex driven truck hangar (40) that doubles as a two wheel drive, a flex drive shaft (33) driven device that enables this motorized mechanism to work like a skateboard truck. This is possible through the interactive workings of a crown gear (49) and a pinion gear (47) (not shown in FIG. 1) which are attached to a shaft end (35) which travels through a sealed bearing set (45) and a mount (46) which is part of the flex driven truck hangar (40). It then travels through a two piece clamshell race bearing (34) that has a tension adjustment by the action of the two machine screws that screw into the flex driven truck hangar (40) after this, the special shaft turns into flexible wound cable which works as a flex-drive shaft (33) which is preferably made out of stainless steel or carbon fiber or regular steel or nylon. This flex-shaft (33) is then welded or fused to a shaft coupler (32) which connects the flex-drive shaft (33) to the 9.6 volt electric motor (30) that is held in place by the flexible motor mount (31) which is connected to the double-kick skateboard deck (12). The 9.6v electric motor's (30) speed is controlled by the electronic speed control (43) which is tucked beneath the natural arch of the flex-shaft (33) the signal is received by the 2 channel receiver (42) mounted under the kick tail. The 2 channel receiver (42) is mounted in a protective case that has a skid pad (39) made of slippery ultra high molecular weight (UHMW) plastic to provide a stopping point or "drag" point during "wheelie" maneuvers. It also has a snap-fit wheel weight mount (41) included so that wheel weights (36) can be snapped on to weight the tail, therefore making it easier to raise the front wheels (21).

FIG. 1 also provides a good side view of the mechanisms that move the robot (10) and in turn steer the skateboard (11). The 55 torque servo (16), designed to move a ⅙ scale figurine, has an arm (15) that extends outward to connect to the lean stand (14) which is connected to the robot's lower right leg. This set-up is known as (body movement #1) and is the most effective in steering the skateboard (11) as it places the greatest amount of weight and mass over the respective sides of the skateboard (11). This body movement #1 is employed in both the custom design and the mass market design.

Part of the pump mill (17) is visible just behind the servo (16) as well as its outer (18) and inner (19) push rods. This mechanism extends the custom robot's (10) body length at the apex of either turn; and makes its body compress or crouch down when steering straight ahead. This gives the custom robot (10) a lower center of gravity on high speed straightaways and adds extra power to the rhythmic workings of the steering system.

FIG. 2 shows the bottom view of the skateboard (11) with the motor arrangement "A". This view can be compared to FIG. 1 which shows almost all the same components attached to the underside of the skateboard. This view also shows the battery packs (27)(28) moved into the forward position as in FIG. 1. The battery packs (27)(28) can be moved forward or backward on the battery pack slide mount (29) as well as held in place at different positions along the battery pack slide mount (29) with set screws; one per side, (not shown). FIG. 2 gives an excellent view of the two wheel drive flex-shaft system. The axle (50) is visible within the flex-driven truck hangar (40) which rides on two race bearings (37) which are fused to the flex-driven truck hangar (40). The crown gear (49) is connected to the axle (50) by means of a set screw. The crown gear (49) is connected to the pinion gear (47) which is fastened to the shaft end (35) which runs through a sealed bearing set which is housed by a bearing mount (46) that is initially held down by the clam-shell race bearing (34) which sorts out the initial irregular movement of the flex-driven shaft (33) which is visible and connected to motor coupler (32) which is held in place by the flexible motor mount (31). The flexible motor mount (31) needs to be flexible at its base to allow total freedom of movement of the flex-driven truck hangar (40). Also it should be noted that the electric motor (30) has to be offset to account for shaft rotation; that would otherwise pitch the flex-driven truck hangar (40) to one side; therefore thwarting the center balancing action of the truck rubbers (23). Also noted is the need to have the pressure applied towards the crown gear (49) when mounting the motor to the skateboard deck (12). This helps to relieve the amount of tension in the flex-drive shaft (33) so it can allow the flex-driven truck hangar (40) to float with less resistance. In this bottom view of the front truck hangar (20) it is noticed that they are wider than normal skateboard trucks in comparison to the width of the skateboard (11). This is to provide a wide base for stability. A unique grind-n-spark strip (44) is embedded into the surface across the width of the most vulnerable part of the truck hangar (20) and flex-driven truck hangars (40). The grind-n-spark strip (44) is made out of flint so it can make sparks when it hits metal or concrete. Also, because the truck hangar (20) and flex-driven truck hangar (40) are made of steel or aluminum it makes a resounding "crack" of a noise when the exposed portion of either truck hangar hits or "grinds" up against a metal or concrete coping or edging. It is suggested that if either truck hangars are going to be made out of plastic, that they have an attached metal base to duplicate the sought after grinding noise. Therefore, all Surfer Joe™, Robo Surfer, Robo Skater and Skater Joe ramps, pools and street courses design with a ⅙ scale will be provided with serrated stainless steel copings or edges (96) to activate the grinding sound (as seen in FIG. 21). [Note that the "grind-n-spark" truck hangar strip would work on full scale human use skateboard trucks.]

Figure 3:
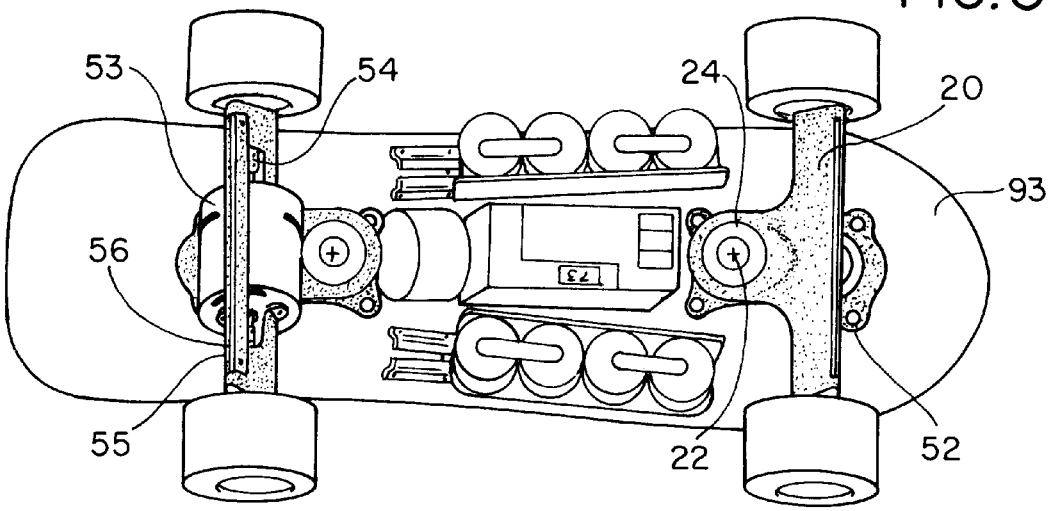
FIG. 3 Is a bottom view of the skateboard showing motor arrangement "B".

FIG. 3 shows a bottom view of the skateboard with motor arrangement "B" (93). This arrangement is the best because it requires the least amount of moving parts, takes up less space, has no rotation inertia problems to overcome and has zero resistance from a flex-drive shaft (33) as shown in FIG. 2. This design allows for the freedom to enable the board (11) and robot (not shown) to turn within a three inch circle without wheel spin. Also shown is a 9.6 volt double shaft electric motor (53) which is coupled to the drive axles by the in-line couplings (54) and held into place by the removable hangar base (55).

Figure 4:
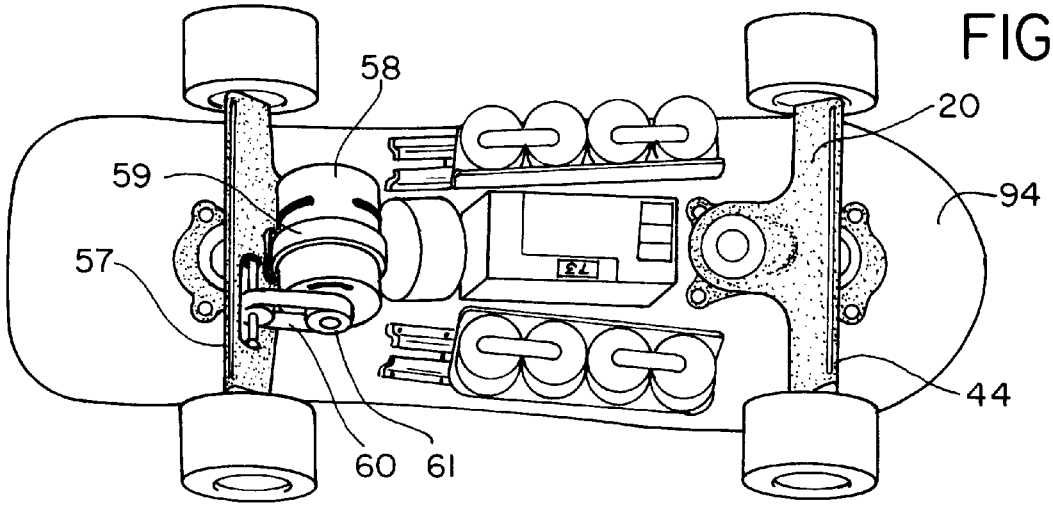
FIG. 4 Is a bottom view of the skateboard showing motor arrangement "C".

FIG. 4 shows a bottom view of the skateboard with motor arrangement "C" (94). It shows a 9.6 electric motor (58) clamped over the kingpin (22) by a motor mount clamp (59) which holds the motor in place so it can spin the drive axle by means of two toothed pulleys (61) and one toothed belt (60) this design is a little more difficult to produce but is designed to make space for a reduction gear box (not shown) mounted in-line with the 9.6 volt electric motor (58). This offset two wheel drive truck hangar (57) also employs a "grind-n-spark" strip (44) as does the front truck hangar (20).

Figure 5:
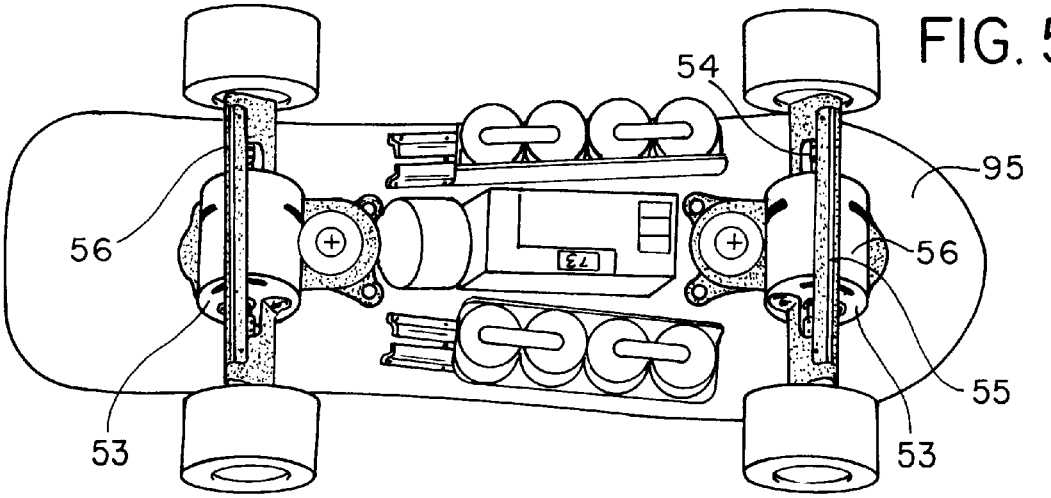
FIG. 5 Is a bottom view of the skateboard showing motor arrangement "D".

FIG. 5 shows a bottom view of the skateboard with motor arrangement "D" (95). This is the arrangement outlined in motor arrangement (93) "B" but adds an in-line 9.6 volt motor (53) to the front truck to make synchronized four-wheel drive possible. Both of the 9.6 volt motors (53) run off the same speed control and therefore, run simultaneously in forward and reverse. This set-up shows that in dropping the rear truck motor, it could go with just front wheel drive, if desired or, vice-versa. It is important to note that these in-line motors are almost the same diameter as the wheels, therefore, it does not allow for much ground clearance between the wheels horizontally; shown in FIGS. 12, 13, and 14 (the end views). These toys will run on smooth terrain and the low ground clearance helps the truck get off coping or curbing without wheel hang-up when making a grind maneuver. It is important to note that larger diameter motors require larger diameter wheels.

Figure 6:
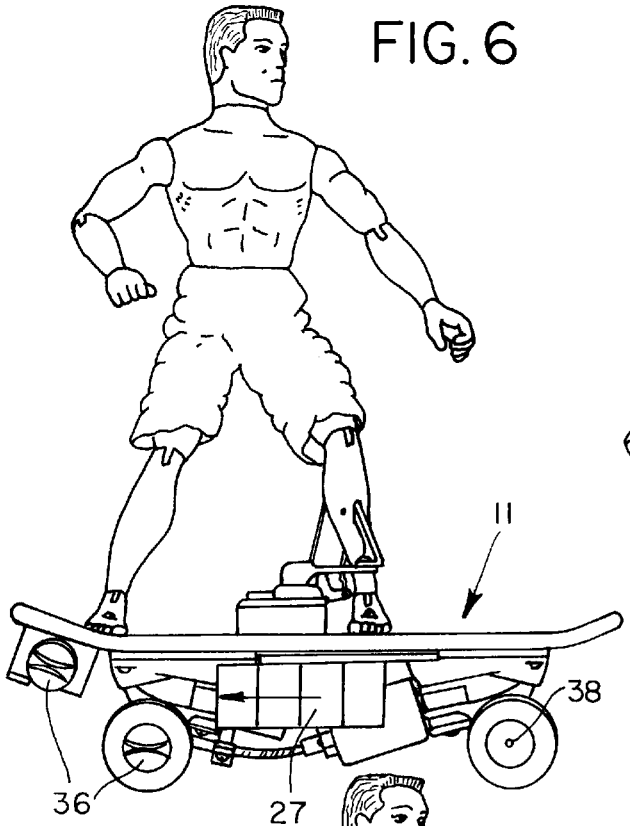
FIG. 6 Is a right side view of the custom robot on the skateboard showing motor arrangement "A" and battery packs and wheel weights in the street-riding position.

FIG. 6 is a right side view of the custom robot (10) on the skateboard (11) with motor arrangement "A". Showing battery packs (27) and wheel weights in street riding position. The battery packs (27)(28) are moved towards the rear; the front wheel weights are taken out and attached behind the truck base plate (13) and flex-driven truck hangar (40). This set up lightens the front end of the skateboard (11) to take on street course riding which entails a lot of flat land tricks and "wheelies".

FIG. 7 is a side view of the robot (10) on skateboard (11) with motor arrangement "A" showing steering components, torque servo (16) and pump mill (17) moved into a forward position by means of a slide plate (26). The slide plate (26) is preferably made out of steel, very thin, yet rigid. The slide plate (26) has both feet of the robot (10), the torque servo (16), the pump stand (63), and the pump mill (17) fastened to the top surface of the slide plate (26). The slide plate (26) has two elongated track holes on which the slide plate (26) moves back and forth. Two set screws (not shown) hold the plate in a desired position.

Figure 8:
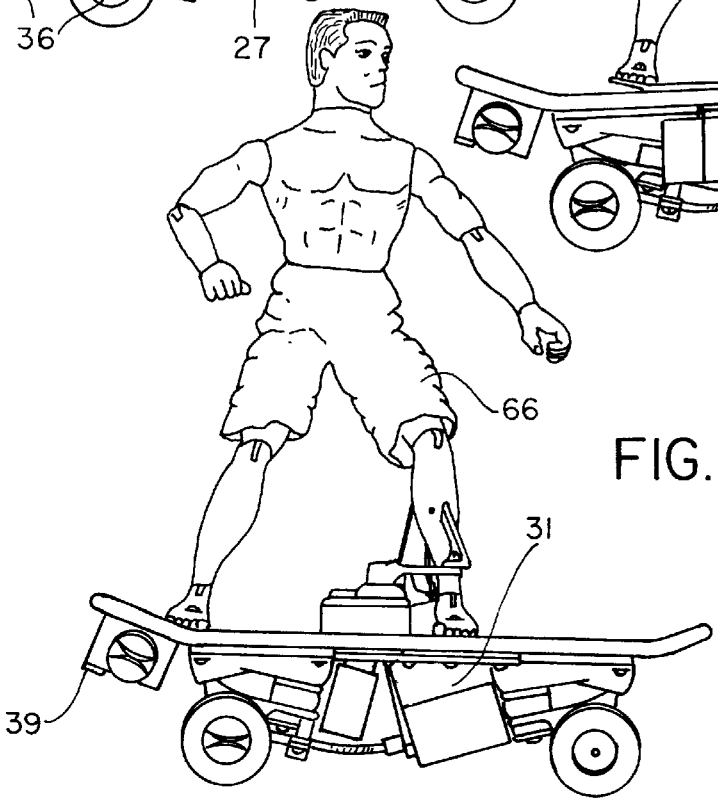
FIG. 8 Is a right side view of the custom robot on the skateboard showing motor arrangement "A" and the battery packs removed to show flexible motor mount.

FIG. 8 is a right side view of the custom robot (10) on the skateboard (11) with motor arrangement "A" showing battery packs (27)(28) removed to show the flexible motor mount (31). There is a thin profile of the motor mount (31) at the point where it bends to meet the bottom of the skateboard deck (12). This allows the electric motor (30) to be pulled toward the rear flex-driven truck hangar (40) by the flex shaft when leaned over in a turn. The flexible mount (31) enables the manufacturer to load-up the flexible mount (31) and electric motor (30) with backing pressure when mounting the motor, in anticipation of the flex-drive shaft (33) needing more slack when the board is leaned over in a turn. All of this helps to free up the flex-driven truck hangar (40) from resistance of movement. It is important to note that the skateboard arrangement "A" is the most preferred set up because it allows for a bigger motor due to its location in the center of the skateboard. This design allows space to accommodate large motors and/or reduction gears depending on different lengths wheel bases, as well as flex-drive shaft (33) lengths and curvatures.

Figure 9:
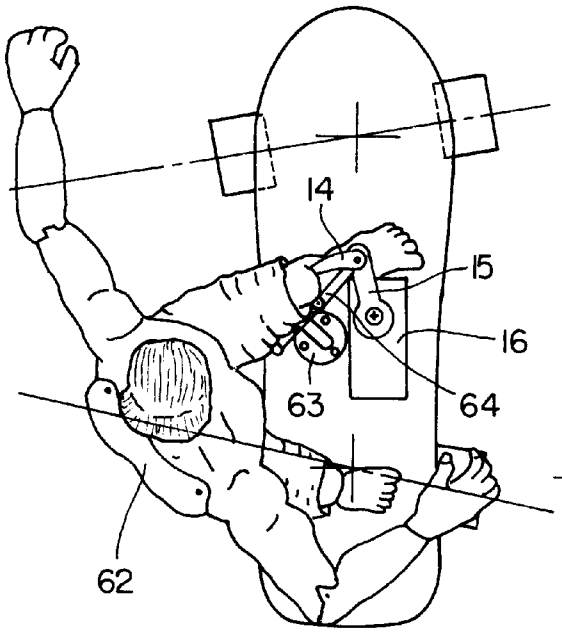
FIG. 9 Is an overhead view of the custom robot in a full extension left-hand turn.

FIG. 9 is an overheard view of the custom robot (10) in a full extension left hand turn. All four wheels swivel in unison, with the wheels facing the inside of the turn being closer together and the wheels on the outside of the turn are further apart. In this view, the robot's (10) upper body is out and over the left side of the skateboard deck (12). It also shows the torque servo (16) with a servo arm (15) that moves the lean stand (14) connected to the robot's (10) lower leg and moves the custom robot (10) and mass market robot (25) from side to side (Body Movement #1). The torso servo cover (62) hides a torso micro servo (67) which twists the custom robot's upper body in the direction of the turn being made (Body Movement #2). FIG. 9 also shows the custom robot (10) in a full backhand twist. Also shown is the pump actuation rod (64) which moves the pump mill (17) which is connected to the pump stand (63).

Figure 10:
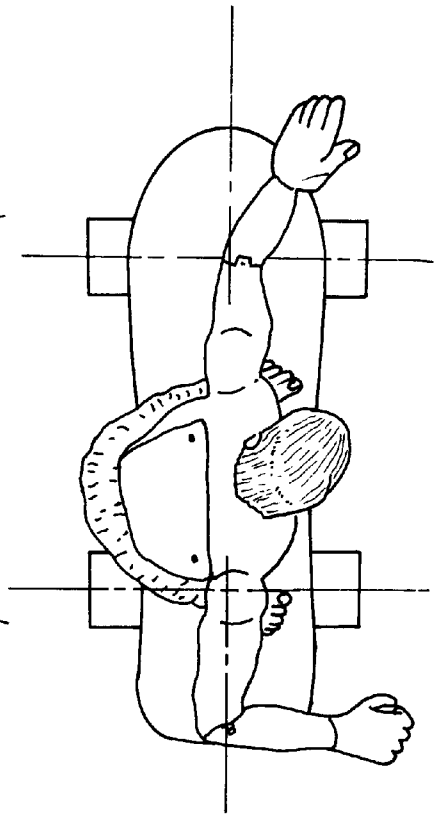
FIG. 10 Is an overhead view of the custom robot in a center balanced go-straight position.

FIG. 10 is an overhead view of the custom robot (10) in a center balanced "go-straight" position. It is in this position that the custom robot (10) is crouched low as well as centered over the skateboard deck (12) to help this along, the rebound rubbers (23) between the truck hangar (20), flex-driven truck hangar (40) and the truck base plate (13).

Figure 11:
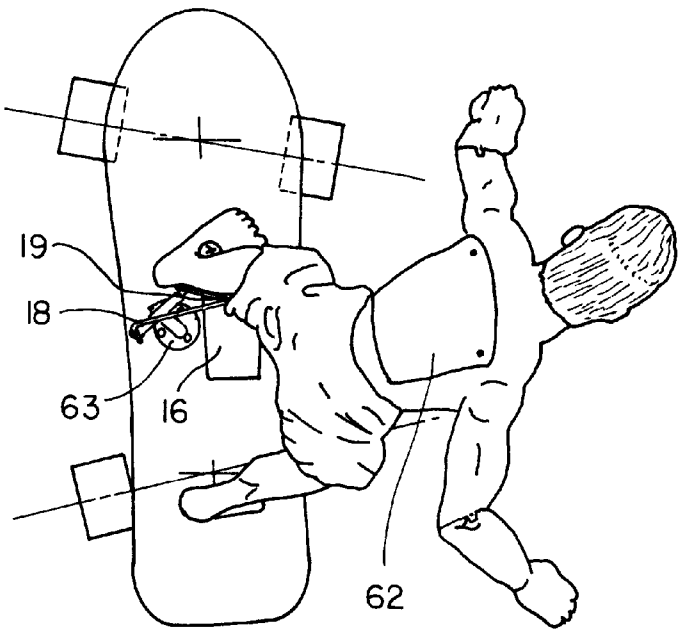
FIG. 11 Is an overhead view of the custom robot in a full extension right-hand turn.

FIG. 11 is an overhead view of the custom robot in a full extension right hand turn. This view shows that the wheels (21) and flex-driven truck hangar (40) swivel off axis and the custom robot's (10) body lurches and twists much in the same way as in FIG. 9 but seen in the opposite direction. Also seen is the 55 torque servo (16) the pump stand (63) and the two pump mill push rods (18)(19).

Figures 12, 13, 14:
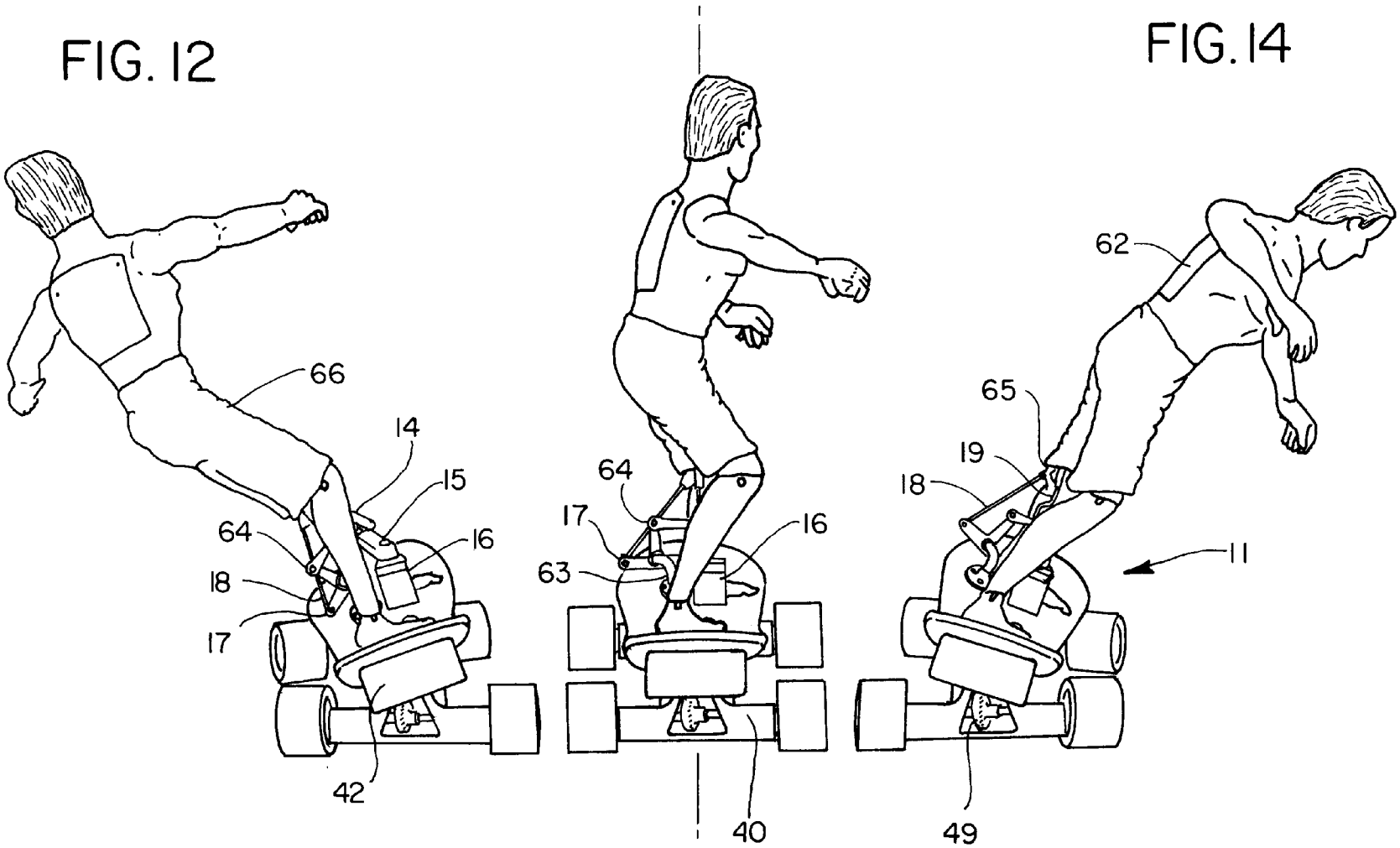
FIG. 12 Is an elevated end view of the custom robot and skateboard showing motor arrangement "A" in the full extension left-hand turn position.
FIG. 13 Is an elevated end view of the custom robot and skateboard in the center balanced go-strait position with the robot crouched to achieve a low center of gravity.
FIG. 14 Is an elevated end view of the custom robot and skateboard showing motor arrangement "A" in the full extension right-hand turn position.

FIG. 12 is an elevated end view of he custom robot (10) in a full extension left hand turn. This view shows that the skateboard deck (12) is tilted to the left as the wheels (21) and truck hangar (20) and flex-driven truck hangar (40) swivel. The whole body of the robot (10) is way out over the left rail of the skateboard deck (12) (Body Movement #1) as well as the robot's (10) upper body twisted in the direction of the turn (Body Movement #2). This view also very clearly shows the workings of the pump mill (17) showing the outer push rod (18) retracted while the inner push rod is pushed up into the back of the robots (10) upper leg through one of the ball joint push rod guides (65) to extend the robot's (10) body which is part of Body Movement #3. Also visible is the rear flex-driven truck hangar (40) showing the cut-out window for the gears (49) and (47) as well as the low ground clearance at the flex-driven truck hangars (40) grind heel where the "spark-n-grind" strip (44) is located.

FIG. 13 is an elevated end view of the custom robot (10) and skateboard (12) in the center-balanced straight position with the robot (10) crouched to achieve a low center of gravity. Visible here is the pump mill (17) on a horizontal plane to the skateboard deck (12). In this position the push rods both retract from the back of the robots (10) upper leg, and in turn lets the weight of the robot's (10) upper body collapse down to its lowest position, seated by the knee joint's (80) stop ledge design (Body Movement #3).

FIG. 14 is an elevated end view of the custom robot (10) and skateboard (11) with motor arrangement "A" in the full extension right hand turn position. This view shows the same three body movements as outlined in FIG. 12 but are turning in the opposite direction. Also visible are the ball-joint push-rod guides (65) and they are preferably made out of a tough plastic such as nylon. The ball-joint push-rod guides (65) have rigid tubes that hold the push rods (18)(19) as they slide in and out. A small brace connected to a ball snaps into a female socket which is carved out of the back of the robot's (10) leg, enabling these guides to swivel in all directions and necessary to take up the swerving angles of the push rods (18)(19) as they work.

Figures 15, 16:
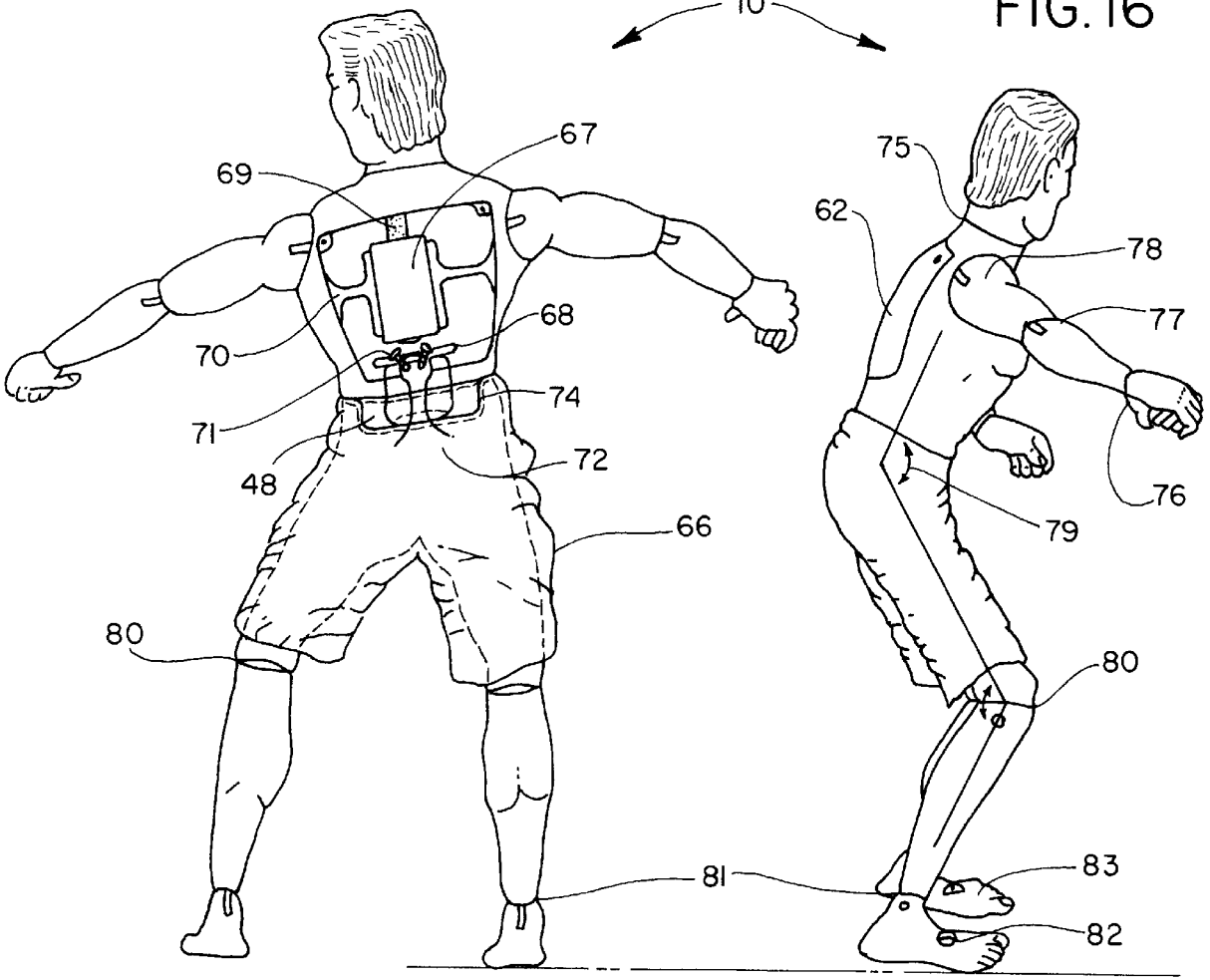
FIG. 15 Is a cutaway back view of the custom robot.
FIG. 16 Is a side view of the custom robot crouched in the lowest center of gravity position.

FIG. 15 is a cutaway back view of the custom robot (10) with the torso servo cover (62) removed and the waterproof micro servo (67), the servo torrent (68), the servo back brace (70) and the foam wedge (69) are revealed. The foam wedge (69) allows the servo to be taken out for service and then put back in. The servo torrent fasteners (71) screw into the snap fit base arbor (72) and then pultrude from the lower body which snaps into the top of the snap-fit waist cylinder (48) which is part of the upper body. This all rotates in the rotating waist joint (74). All these components allow the waterproof micro servo (67) to push against the robot's back and rotate in synchronization with the other steering components. Also shown are the robot's surf trunks (66) and a rear view of all the moveable joints on the custom robot (10). The rotating jackknife ankle joints (81) provide the ability to maintain the upper body weight over one side of the board or the other. Also shown is the back of the knee joint with the stop ledge open (80). The waist joint (74) and ankle joint (81) are molded in loose tolerances to facilitate ease of movement.

FIG. 16 shows the side view of the custom robot (10). It shows the molded angle of the pelvis (79) designed to hold the robot in such a way so that the upper body weight is centered over the ankles and centered over the width of the board. Especially when the custom robot (10) is in the center balanced go-straight position crouched down to lower the center of gravity. The knee joint (80) is made to fully open at approximately a 62 degree angle and as FIG. 16 shows, is completely closed at approximately a 47 degree angle with stop ledge fully engaged.

The upper body joints are also shown including the rotating wrist joints (76), the rotating jackknife elbow joints (77), and the rotating jackknife shoulder joints (78). The rotating jackknife joints rotate, as well as, pivots forward and back. The other rotating joints rotate only. These upper body joints are moveable, but are made to hold position due to the tight tolerances molded into the joint parts, thereby, allowing the operator to place the robot in different desired styles for fun and different turning sensations.

Both the custom and mass market robots are preferably constructed out of hard plastic, in a hollow construction. The plastic must be of a high molecular weight to give the robots enough bulk weight to steer the skateboard.

Figures 17, 18:
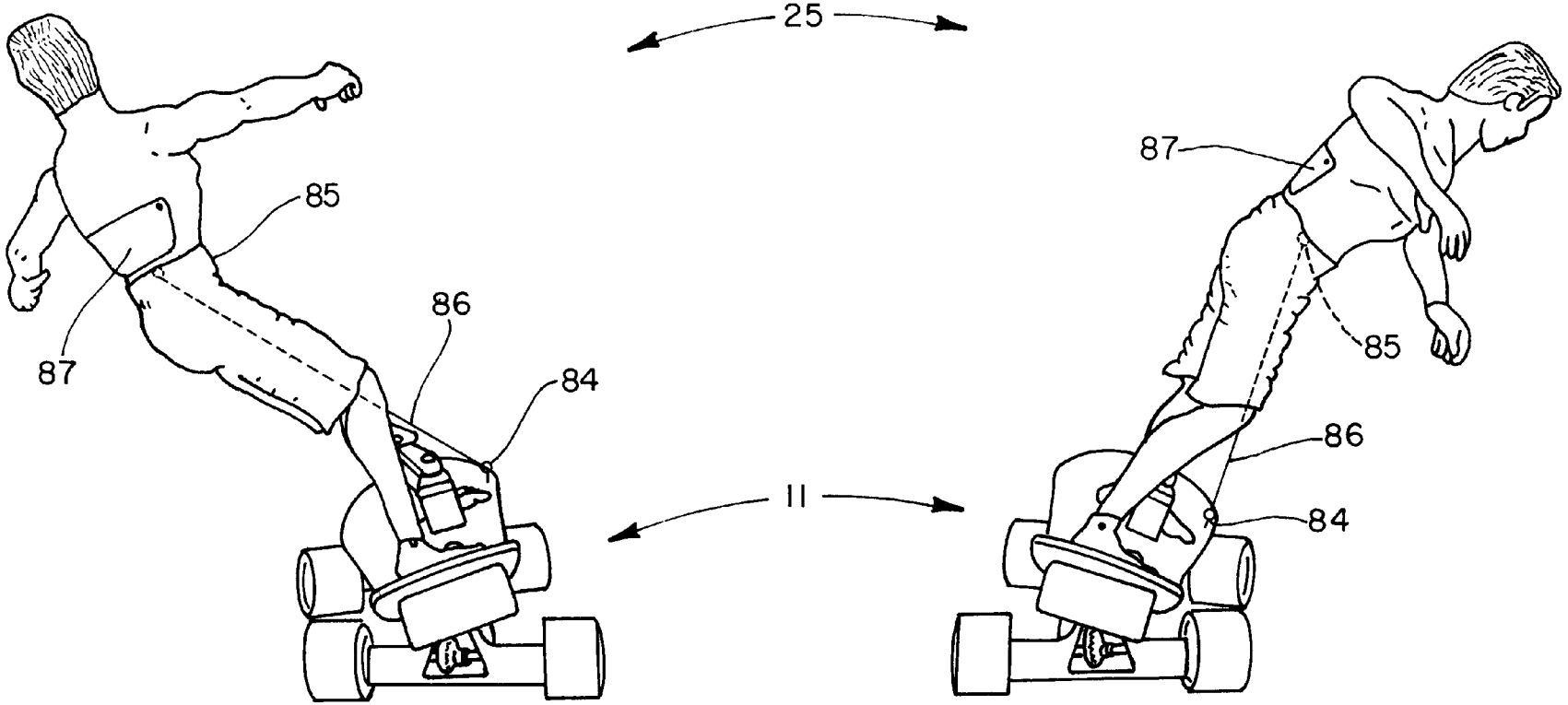
FIG. 17 Is an elevated end view of the mass market robot on the skateboard showing motor arrangement "A" in a full extension left-hand turn recoil away position.
FIG. 18 Is an elevated end view of the mass market robot on the skateboard showing motor arrangement "A" in a full extension right-hand turn recoil return position.

FIG. 17 is an elevated end view of the mass market robot (25) on the skateboard (11) with motor arrangement "A" in a full extension left hand turn, performing Body Movements #1 and #2. The torso recoil cover (87) is shown and it covers the recoil mechanism which has a recoil string (86) that feeds out from just below the mass market robot (25) waist through the waist mount string eye (85) down to where the string is anchored, on the left side of the skateboard (11) to the deck mount string eye (84). This view also demonstrates that when the mass market robot (25) is in a full extension left hand turn, the amount of string (86) visible outside the mass market robot (25) is at its longest length.

FIG. 18 is an elevated end view of the mass market robot (25) on the skateboard (11) with motor arrangement "A" in a full extension right hand turn. Showing all the same components as in FIG. 17, but because the rider is turning in the opposite direction, the amount of recoil string (86) visible outside the mass market robot (25) is at its shortest length. This suggests how the recoil stringwinder (92)(89) works to twist the mass market robots (25) upper body in the direction of the turn being made. When the string is at its shortest length as if FIG. 18 the waist mount string eye (85) is at its closest point to the board mount stringeye (84) at this same point the stringwinder cylinder is loaded with string (86) and the recoil spring (89) is in its return position and has less tension. So as the primary servo (55) moves the mass market robot (25) body away from the board mount string eye (84). The recoil string (86) is pulled out from the stringwinder inside the mass market robots upper body and in turn, twists the mass market robots (25) upper body. As the servo (55) moves the mass market robots body to be straight over the skateboard (11) the recoil mechanism is halfway out from its return position shown in FIG. 18 and sets the upper body in the "go straight" center balanced position as shown in FIG. 10. When the servo (55) puts the mass market robot (25) body out over the left rail in a full extension left hand turn as seen in FIG. 17 the recoil mechanism is in the away position. Therefore, the mass market robots (25) body movement has pulled the recoil string (86) even farther away from the board mount string eye (84) and therefore twists the upper body as the string unwinds the stringwinder (92) into the apex of a left hand turn.

Figures 19, 20:
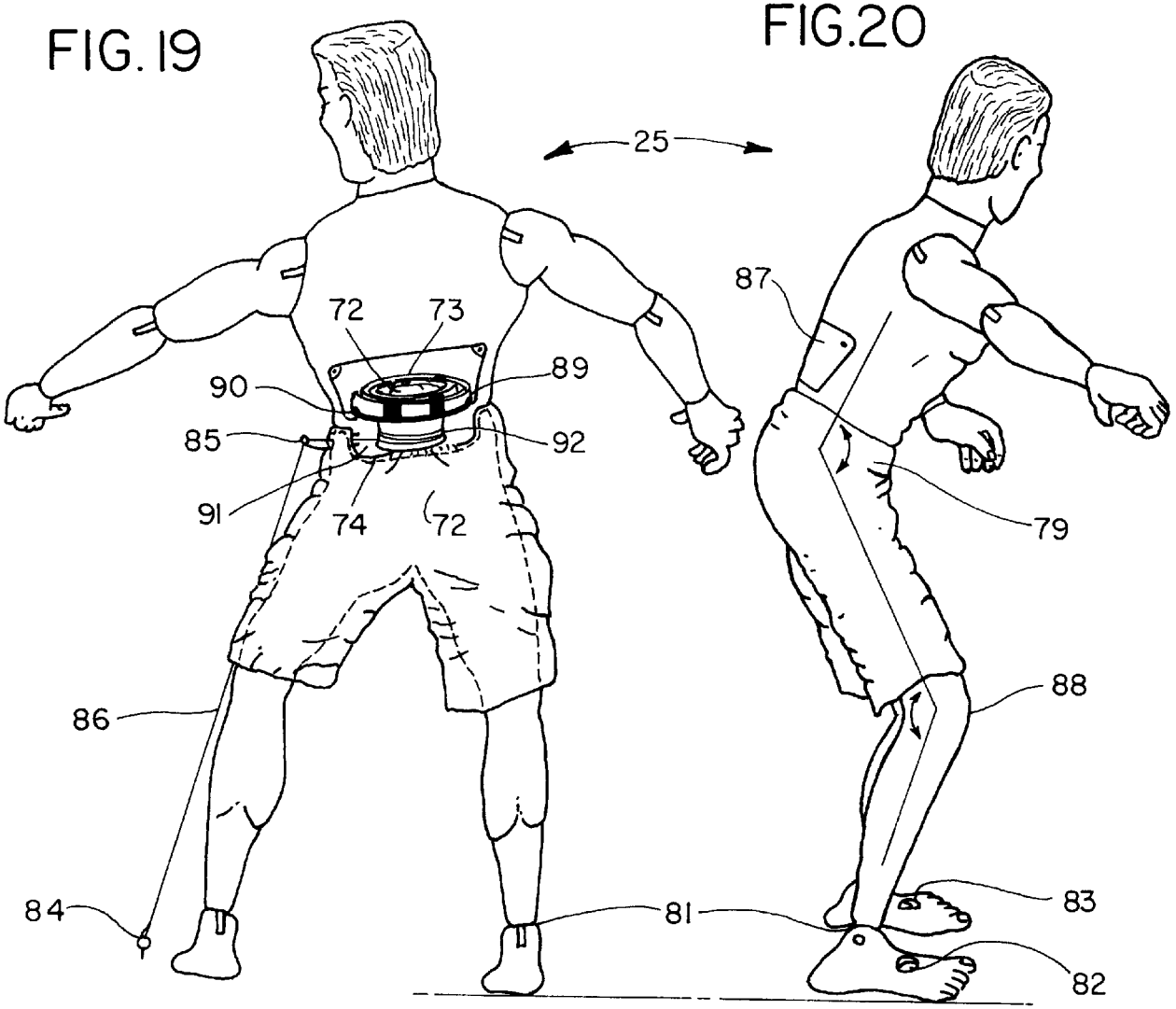
FIG. 19 Is a cutaway back view of the mass market robot.
FIG. 20 Is a side view of the mass market robot.

FIG. 19 is a cutaway back view of the mass market robot (25). Showing the recoil mechanism, and the snap-fit base arbor (72) stump is seen just under the recoil mechanism. It travels up thru the middle of the stringwinder (92) comes out through the top of the recoil plate (90) and recoil spring (89). It is at this place that the end of the recoil spring (89) is attached to the top of the snap-fit base arbor (72) by the use of the arbor to recoil fastener (73). It is also at this place that the mass market robots (25) upper body which is attached to the recoil spring (89) is fastened to the snap fit base arbors top which is part of the robot's lower body. Also shown is the recoil string (86) exiting the stringwinder (92) cylinder through the waist joint string window (91) which is a slit cut out of the upper body side of the rotating waist joint (74). The recoil string (86) then extends out of the body through the waist mounted string-eye (85) (which is preferably made out of stainless wire) then down to where it is held fast to the deck mounted string eye (84).

FIG. 20 is a side view of the mass market robot (25) and shows the molded pelvis at approximately 55 degree as well as the molded knee (88) at approximately 52 degree. This view also shows the rotating jackknife ankle joint (81) which allows the servo to move the robot side to side over the skateboard to create Body Movement #1 as well as Body Movement #2.

FIG. 21 is a front view of a "Robo Skater" quarter pipe with a drop-in platform and a serrated stainless steel coping (96). This view shows a robot (10) on a skateboard (11) grinding and sparking the serrated coping (96). Note that two of these quarter pipes can be placed across from each other to make a half pipe (not shown).

FIG. 22 is a close up view of the serrated stainless steel coping (96) mounted in the edge of a "Robo Skater" skateboarding quarter pipe. This serrated coping (96) can be made out of aluminum or regular steel.

FIG. 23 is an elevated front view of a "Robo Skater" skateboarding half-pool with a drop-in platform that can be entered or exited at the floor; and has an outside guide track (97) atop the platform. This unique half-pool also incorporates a serrated stainless steel coping (96). This view also shows two robots (10) on skateboards (11) entering and riding the platform as well as, one robot (10) on a skateboard (11) is going into a backhand turn in order to make a front side carve, and another at the apex of a front side carve, while grinding and sparking. Note: two half-pools can be placed across from each other to make a full pool.

Figure 24:
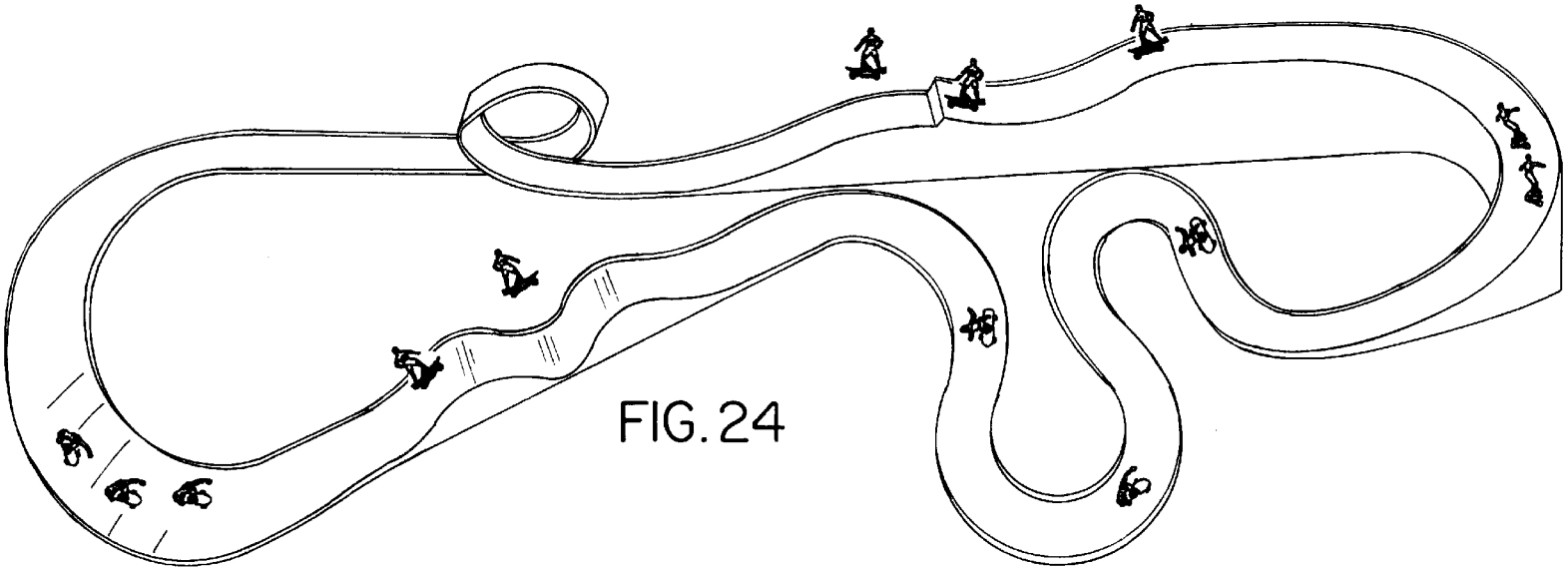
FIG. 24 Is an elevated view of a four-lane race course with guide-track boarders showing a robo skater traveling therein.

FIG. 24 shows an elevated view of a "Robo Skater" 4-lane race course made in different sections with "Robo Skater" guide track (97).

Figure 25:
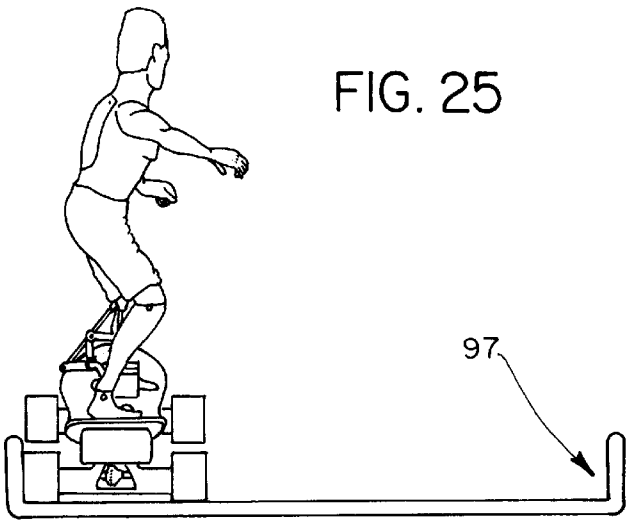
FIG. 25 Is a cutaway view of the robo skater on the guide track.

FIG. 25 is a cutaway view of the "Robo Skater" (10)(11) guide track (97) showing an end view of a robot (10) on a skate and board (11) with the left side wheels up against the guide track's (97) smooth sidewall. This guide track (97) features a granular running surface to offer wheel traction, and heightened sidewalls at a 90 degree angle to the running surface. These sidewalls are smooth to allow the sidewalls of the skateboard's wheels (21) to run up against, and at the same time, keep the robot (10) and skateboard (11) on course and moving forward. To be effective these sidewalls have to be at least half or preferably the full height of the skateboard's wheel diameter.

Summary, Scope, and Ramifications

A thin protective cowling could be placed around the batteries, motor and other mechanism for aesthetic purposes. The skateboard toy, "Robo Skater" should be sold with two different frequencies: one in a goofy-foot (right foot forward) stance and the two other different frequencies in a regular foot stance (left foot forward). "Robo Skater" could be made to interchange stances on the skateboard as well as on to other vehicles such as: a remote control surfboard, a remote control snowboard as well as a remote control windboard.

The figurine's body movements in this application are generated by remote control servos and delivered to the figurine's body by arms and push rods. This being the simplest and most direct method of movement. However, known robotic drive means could also be used to perform these same movements, or even more extensive or exaggerated body movements such as: wheel and pulley drives from controlled electric motors taking signals from a remote control transmitter. Battery packs can be made to be detachable and interchangeable to assist charging.

"Robo Skater" could have a camera mounted in a detachable helmet to video the movements of the skateboard from the figurine's point of view. Although this application discloses the skateboard and electric motor arrangements as a toy model, the invention outlined could be scaled up to serve as a full scale transport for human use run by a hand held radio control transmitter.

The robo skater is designed to have flint strips inlaid on the truck hangars to produce sparks upon hard contact with serrated coping. The skateboard would work in conjunction with the serrated metal coping or edges on a market made ramp, pool, or curb to produce sparks thereby imitating real life skateboarding effects. Also a wide section track can be built to have wheel-high boards to keep the forward moving "Robo Skater" in play.

Lastly, the "Robo Skater" can be adapted with both sound effects and/or interactive audio communications.

What is claimed is:

1. A radio controlled steerable self-propelled skateboard toy comprised of:

an erect figurine pivotally attached to a skateboard;

said skateboard being motorized having a deck having a general longitudinal axis, said deck having an upper surface and having a lower surface;

said figurine being attached to the upper surface of said deck with the point of attachment being at the figurine's feet and wherein the figurine is located on said skateboard at a center balanced pivotal position;

a free floating front truck hangar and a free floating back truck hangar attached to the lower surface of the deck;

two front wheels mounted on said free floating front truck hangar and two back wheels mounted on said free floating back truck;

a variable speed motor attached to said lower surface of said deck;

a power source operatively connected to the motor and which operatively controls said variable speed motor;

a control means operatively connected to said power source and motor for continuously and differentially varying, at an operator's control, any level of power supplied from the power source to the motor;

wherein the control means further includes a steering system configured to control the movement of the skateboard by pivotal movement of the figurine relative to the skateboard.

2. A skateboarding toy according to claim 1 wherein said figurine is multi-jointed and moveable.

3. A skateboarding toy according to claim 1 wherein the control means includes a control box adapted to be hand held remote from the skateboard.

4. A skateboarding toy according to claim 1 wherein the control means comprise radio signal transmitting means adapted to be hand held and manipulated by the operator at a remote location from the skateboard, and a signal receiving means incorporated in the skateboard and operatively associated with the power source and with the motor, the signal transmitting means emitting command signals and the signal receiving means receiving the command signal and applying power to the motor in substantial conformance to the command signals.

5. A skateboarding toy according to claim 1 having a steering system that is configured to control the movements of the figurine's body in two ways, first, the figurine's whole body can move so the weight is on one side of the skateboard or the other due to a first servo at the base of the figurine's foot, second, the figurine's upper body can rotate to move in the same turning direction as the skateboard while also swinging an arm due to a second servo in the figurine's back.

6. A skateboard toy according to claim 1 having a steering system that is configured to control the movement of the figurine's body so it can extend up and retract down relative to the skateboard deck by a pump mill located at the base of the figurine's foot.

7. A skateboarding toy as claimed in claim 1 wherein said motor is configured to be centered and attached to the lower surface of the skateboard deck by a flexible motor mount and flexible drive shaft.

8. A skateboarding toy as claimed in claim 1 wherein said motor is configured to be centered between the two back wheels of the skateboard and attached to the lower surface of the skateboard deck.

9. A skateboarding toy as claimed in claim 1 wherein said motor is configured to be off set from the center point between the two back wheels and attached to the lower surface of the skateboard deck.

10. A skateboarding toy as claimed in claim 1 wherein said motor is configured to be centered between the two back wheels of the skateboard and an additional motor is configured to be centered between the two front wheels of the skateboard and both motors are attached to the lower surface of the skateboard deck.

11. A skateboarding toy as claimed in claim 1 wherein said wheels are weighted.

12. A skateboarding toy as claimed in claim 1 wherein said wheels weights are detachable and interchangeable.

13. A skateboarding toy as claimed in claim 1 wherein said power source are comprised of battery packs which are configured to slide along the longitudinal axis of the skateboard.

14. A skateboarding toy as claimed in claim 1 having a slide plate attached to the upper surface of the skateboard deck which is configured to move the figurine and steering mechanism into different desired positions.

15. A skateboarding toy as claimed in claim 1 having a recoil spring mechanism connected to the figurine and the upper surface of the skateboard deck configured to rotate the figurine's upper body.

16. A skateboarding toy as claimed in claim 1 wherein the figurine is mounted either with its right foot forward or mounted with its left foot forward.

17. A skateboarding toy as claimed in claim 1 having flint strips in laid to the back and forward free floating truck hangars capable of producing sparks when the skateboard comes into contact with another hard surface.

* * * * *